US011027954B2

(12) United States Patent
Doherty

(10) Patent No.: US 11,027,954 B2
(45) Date of Patent: Jun. 8, 2021

(54) MULTIPURPOSE DEVICE

(71) Applicant: Roger Doherty, Clonmany (IE)

(72) Inventor: Roger Doherty, Clonmany (IE)

(73) Assignee: Roger Doherty, Clonmany (IE)

( * ) Notice: Subject to any disclaimer, the term of this patent is extended or adjusted under 35 U.S.C. 154(b) by 726 days.

(21) Appl. No.: 15/120,885

(22) PCT Filed: Feb. 26, 2015

(86) PCT No.: PCT/IB2015/051447
§ 371 (c)(1),
(2) Date: Aug. 23, 2016

(87) PCT Pub. No.: WO2015/128840
PCT Pub. Date: Sep. 3, 2015

(65) Prior Publication Data

US 2016/0368748 A1 Dec. 22, 2016

(30) Foreign Application Priority Data

Feb. 26, 2014 (GB) ..... 1403401
Apr. 10, 2014 (IE) ..... 20140100
(Continued)

(51) Int. Cl.
*B66F 19/00* (2006.01)
*E02D 29/14* (2006.01)
*E04H 17/26* (2006.01)

(52) U.S. Cl.
CPC ..... *B66F 19/005* (2013.01); *E02D 29/14* (2013.01); *E02D 29/1418* (2013.01); *E04H 17/265* (2013.01)

(58) Field of Classification Search
CPC ..... B66F 19/005; B66F 2700/00; B66F 2700/02; B66F 2700/055; E04H 17/265; E02D 29/1445
(Continued)

(56) References Cited

U.S. PATENT DOCUMENTS 2,511,657 A 6/1950 Welch
5,775,674 A 7/1998 Bigham
(Continued)

FOREIGN PATENT DOCUMENTS

FR 2 677 632 A1 12/1992
FR 2679544 A1 * 1/1993 ..... B66C 23/48
(Continued)

OTHER PUBLICATIONS

Foreign Translation of KR 470567 Y1 (Year: 2013).*
(Continued)

*Primary Examiner* — Tyrone V Hall, Jr.
*Assistant Examiner* — Abbie E Quann
(74) *Attorney, Agent, or Firm* — Pearne & Gordon LLP

(57) ABSTRACT

A stand-alone multipurpose lifting device includes an elongated vertical support section having a planar base section with an upper end including a substantially U-shaped receiving bearing including a plurality of pivot slots on either side of the U-shaped bearing and an angled elongated lever arm section. The lever arm section includes an angle strengthening gusset and a detachable extension arm and handle including a receiving sleeve for fitting over and receiving the end of the lever arm section. A device for cracking a seal formed around a manhole cover includes a horizontal cross bar section including a bottle jack holder recess, a bottle jack retaining means, two opposed leg sections, support struts between the horizontal cross bar and leg sections and a jack cap section including two lifting eyes including a hook and
(Continued)

lifting chains for attaching to a manhole lifting arm detachably connected to a manhole cover.

7 Claims, 12 Drawing Sheets

(30) Foreign Application Priority Data

Jun. 27, 2014 (IE) ..... 20140158
Oct. 1, 2014 (IE) ..... 20140247

(58) Field of Classification Search
USPC ..... 254/130, 134, 131; 414/684.3; 294/17
See application file for complete search history.

(56) References Cited

U.S. PATENT DOCUMENTS

| | | | |
|---|---|---|---|
| 6,520,482 | B1 | 2/2003 | Bigham |
| 2003/0085390 | A1 | 5/2003 | Bigham |

FOREIGN PATENT DOCUMENTS

| | | | | | |
|---|---|---|---|---|---|
| FR | 2 702 753 | A1 | | 9/1994 | |
| GB | 191315236 | A | * | 7/1914 | ..... B66F 19/005 |
| KR | 2005039814 | | * | 4/2005 | |
| KR | 2005039814 | A | * | 4/2005 | |
| KR | 470567 | Y1 | * | 12/2013 | |

OTHER PUBLICATIONS

Foreign Translation of FR2679544A1 (Year: 1991).*
KR 470567 Abstract translation (Year: 2013).*
KR 2005039814A translation (Year: 2005).*
GB 191315236A translation (Year: 1913).*
Kim translation (Year: 2004).*
Kang translation (Year: 2013).*
International Search Report and Written Opinion of Corresponding Application No. PCT/IB2015/051447; dated May 20, 2015.

* cited by examiner

MULTIPURPOSE DEVICE

INTRODUCTION

The invention relates to a stand-alone multipurpose device for lifting, pulling and/or manoeuvering cumbersome heavy objects such as manhole covers or fence posts. The invention also relates to a tool for cleaning a key insert on a manhole cover and a device for cracking sealed manhole covers.

There are many tasks that require a lot of strength which an individual cannot do alone yet do not warrant the use of heavy machinery. For example, unwanted fence posts can be very hard to remove from the ground, concrete slats and manhole covers are typically extremely heavy and cumbersome to lift and manoeuvre by an individual on their own. When trying to lift manhole covers the access points to grab the cover are sometimes covered in or recessed and inaccessible.

There is a need for a device which allows an individual to carry out different laborious manual tasks without requiring assistance.

STATEMENTS OF INVENTION

According to the invention there is provided a stand-alone multipurpose lifting device comprising;

an elongated vertical support section having a planar base section with an upper end comprising a substantially U-shaped receiving bearing comprising a plurality of pivot slots on either side of the U-shaped bearing; and an angled elongated lever arm section comprising quick release attachment means at one end for attaching a working head to the lever arm and a detachable extension arm and handle at the other end distal to the working head for holding by a user and applying a downward force on the lever arm section;

wherein the lever arm section comprises an angle strengthening gusset and the detachable extension arm and handle comprises a receiving sleeve for fitting over and receiving the end of the lever arm section.

Most preferably the lever arm is pivotally attached to the vertical section by means of a pivot pin inserted through one of the pivot slots on the U-shaped receiving bearing and a corresponding receiving aperture on the lever arm section.

In one embodiment of the invention the height of the lever arm in the vertical section is adjustable by choosing a lower or higher pivot slot on the U-shaped receiving bearing to which the lever arm section is attached.

In one embodiment of the invention the receiving sleeve on the extension arm and handle comprises apertures which correspond with apertures on the distal end of the lever arm section and the receiving sleeve is fitted over the end of the lever arm and secured to the lever arm using a pivot and pin means.

In another embodiment of the invention the stand-alone multipurpose lifting device comprises a detachable stool section wherein the elongated vertical section is pivotally mounted on the stool section and the elongated vertical support section can rotate 360° on the stool section. Preferably the planar base section comprises a circular receiving opening or bushing for engaging with a corresponding circular bar extending upwardly from the stool section.

In one embodiment of the invention the stand-alone multipurpose lifting device comprises a wheeled base section wherein the wheeled base section comprises a rectangular platform and the vertical support section is permanently attached towards the front of the platform and a spring buffer means is attached towards the rear of the platform.

In one embodiment of the invention the working head comprises any one or more of a hook device, a T bar head, a fence post head, and/or a jack head. Preferably the hook device comprises a manhole lifting arm, a concrete slab lifting arm and/or a scissor grab device. Most preferably the manhole lifting arm and/or concrete slab lifting arm comprises a central hook for attaching to the hook device attached to the lever arm, receiving openings for receiving and securing the manhole lifting and concrete slab lifting keys to the lifting arm and safety angle stops to secure the keys in position on the lifting arm.

In one embodiment of the invention the hook device attached to the lever arm comprises an electro magnet.

Preferably the stand-alone multipurpose device is for use by an individual to lift and/or pull any one or more of manhole covers, concrete slurry slats, fence posts or other heavy objects.

According to another embodiment of the invention there is provided a multi-headed device for removing dirt and debris from a manhole cover key recess comprising an auger head, a screwdriver head, a splayed key head and a ball head wherein the device is substantially in the form of an X-shape. Preferably the screwdriver head is curved and comprises a detachable spring loaded safety cover. Most preferably the ball head is at an end opposite to the auger head.

In one embodiment of the invention the auger head and screwdriver head are detachably attached.

According to another embodiment of the invention there is provided a device for cracking a seal formed around a manhole cover comprising;

a horizontal cross bar section comprising a bottle jack holder recess, a bottle jack retaining means;

two opposed leg sections;

support struts between the horizontal cross bar and leg sections; and a jack cap section comprising two lifting eyes comprising a hook and lifting chains for attaching to a manhole lifting arm detachably connected to a manhole cover.

In one embodiment of the invention the bottle jack retaining means comprises a retractable lever arm on one side of the bottle jack holder recess comprising a circular head section and a retractable spring on the opposite side of the bottle jack holder recess wherein the circular head section of the retractable lever arm in its working position fits around the bottle jack holder and is secured in place by the retractable spring. Preferably the device has a guide channel or spreader on either side of the recess extending perpendicular to the horizontal bar to guide the lifting chains.

The invention also provides a method of opening and lifting a manhole cover comprising the steps of;

removing dirt and debris from a manhole cover key recess using a multi-headed device of the present invention;

cracking the seal formed around a manhole cover using a device according to the present invention; and lifting and moving the manhole cover using a multipurpose lifting device of the present invention.

BRIEF DESCRIPTION OF THE INVENTION

The invention will be more clearly understood from the following description thereof with reference to the accompanying drawings in which:—

Figure 11:
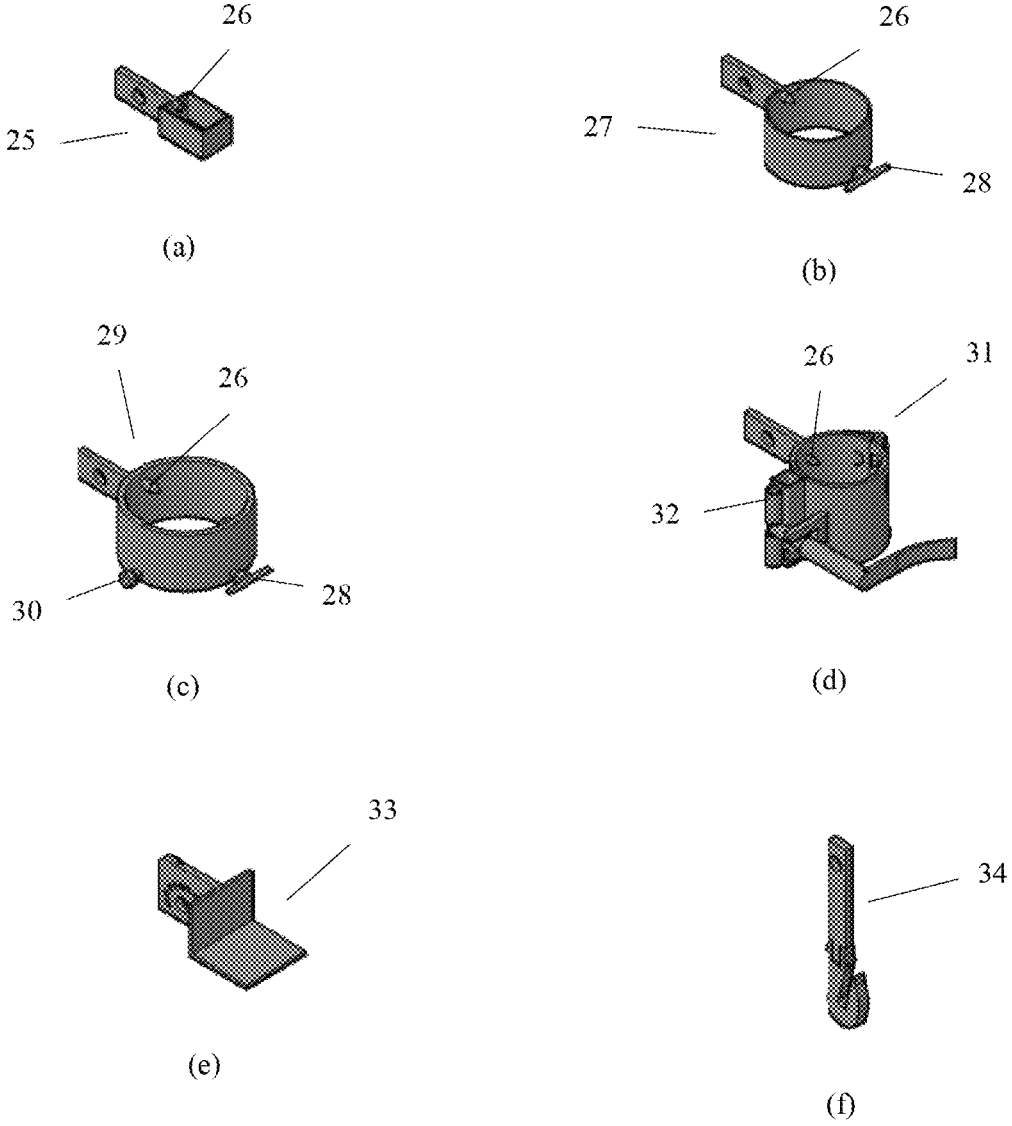
Figure 12:
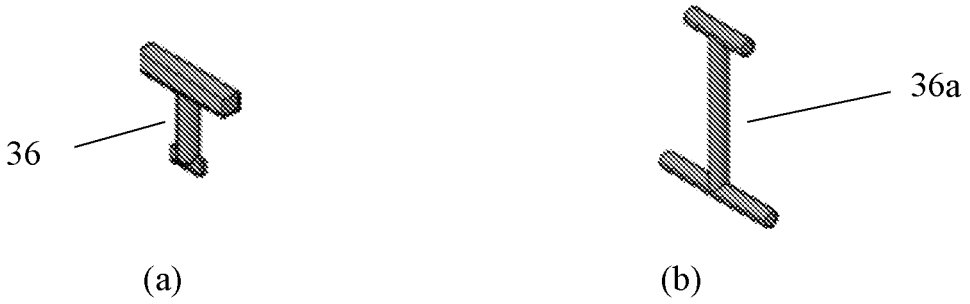
Figure 13:
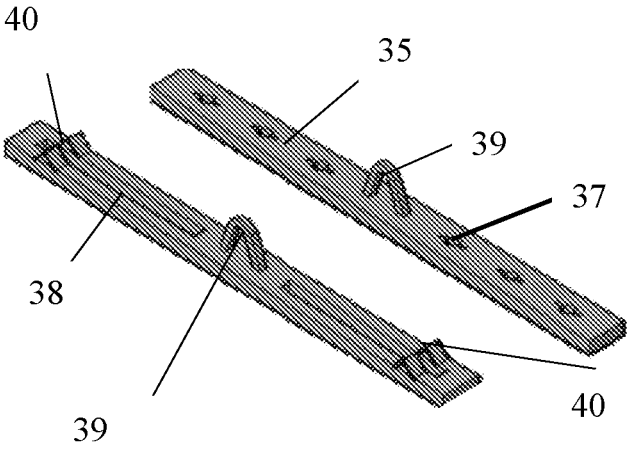
Figure 14:
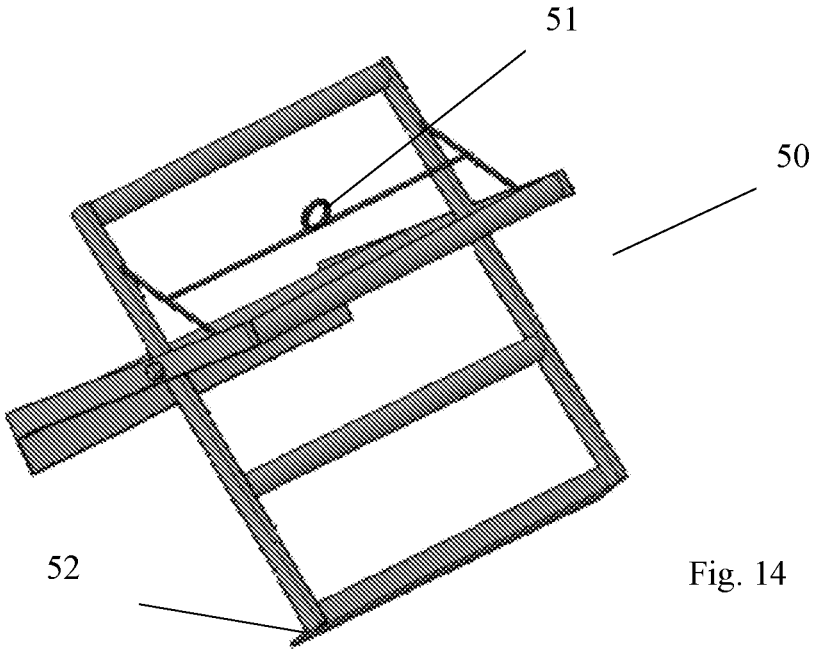
Figure 15:
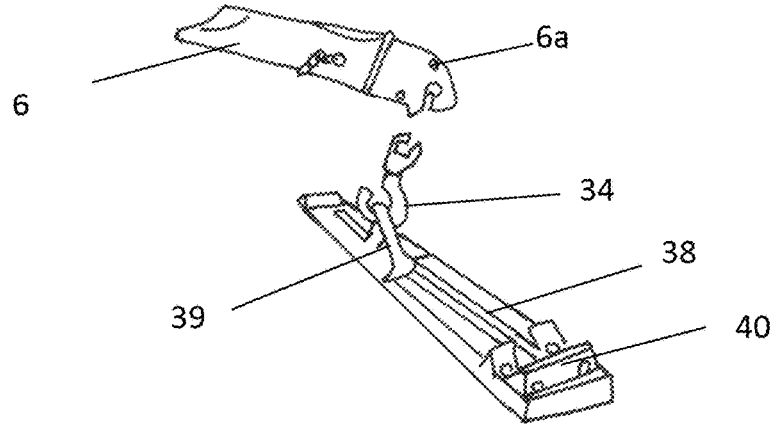
Figure 16:
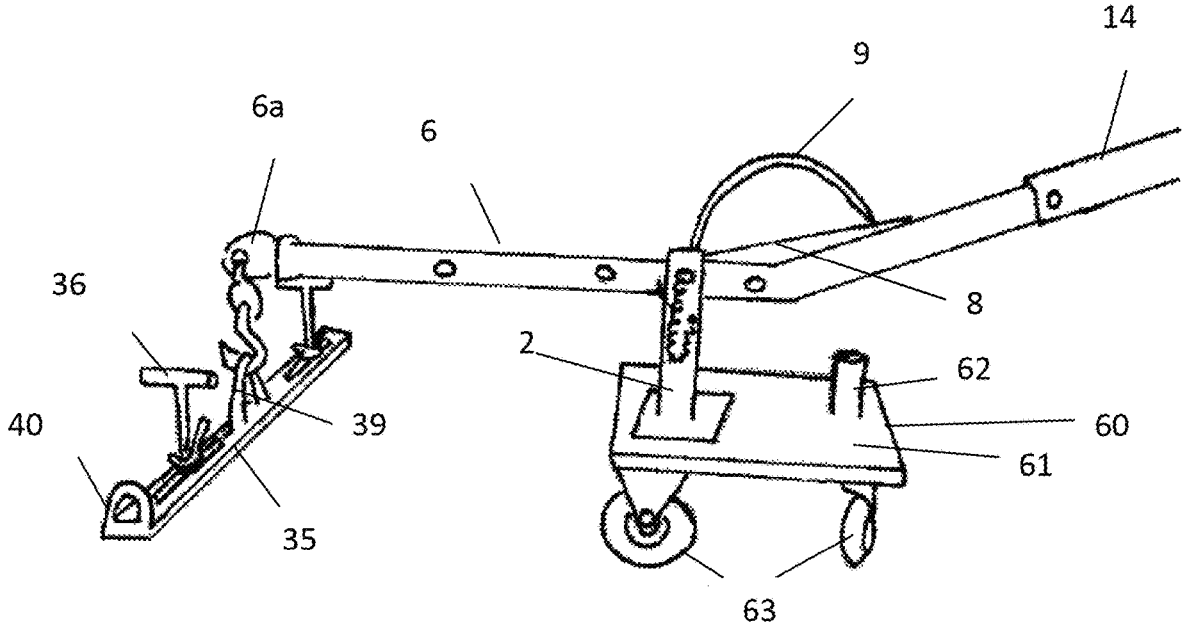
Figure 17:
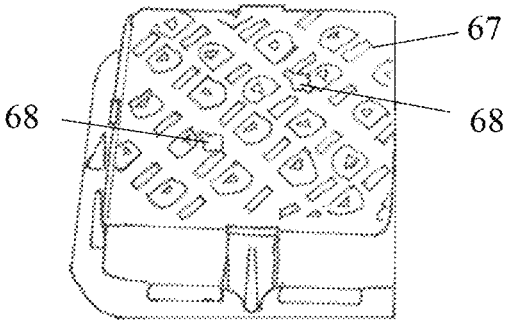
Figure 18:
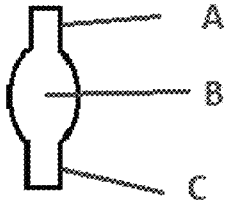

FIG. 11 (*a*) to (*f*) are views of the different working heads attachable to the working end of the lever arm of the device according to the invention;

FIG. 12 is a perspective view of a manhole lifting key (a) and a cattle slat lifting key (b);

FIG. 13 are side perspective views of manhole and concrete slab lifting arms according to the invention;

FIG. 14 is a side perspective view of a scissor slab lifter grab according to the invention;

FIG. 15 is a side perspective view of a lifting hook attached on the working end of the lifting device according to the invention attached to a manhole lifting arm;

FIG. 16 is a side perspective view of a multipurpose lifting device on a wheeled base according to the invention;

FIG. 17 is a side perspective view of a manhole cover and key insert recess openings;

FIG. 18 is a schematic top view of a key insert recess opening.

Figure 19:
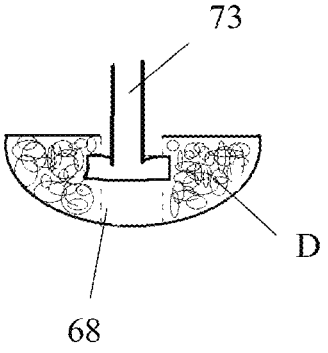
Figure 20:
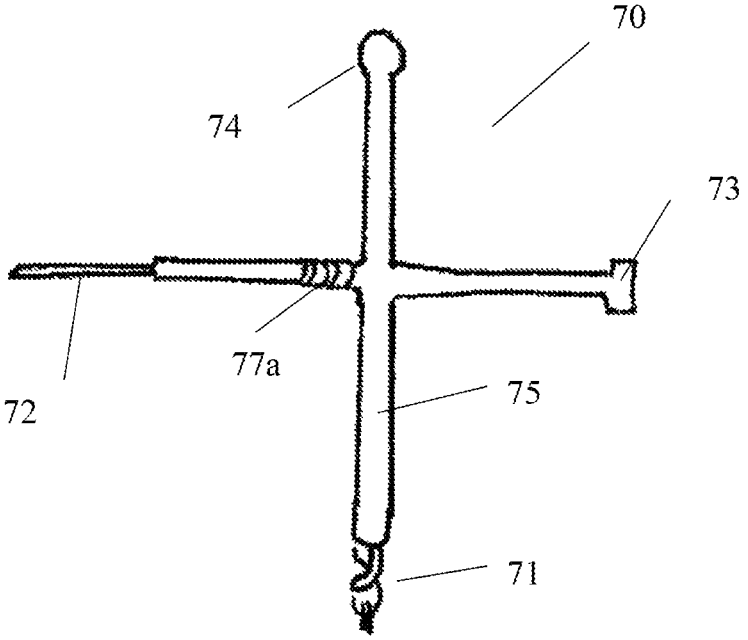
Figure 21:
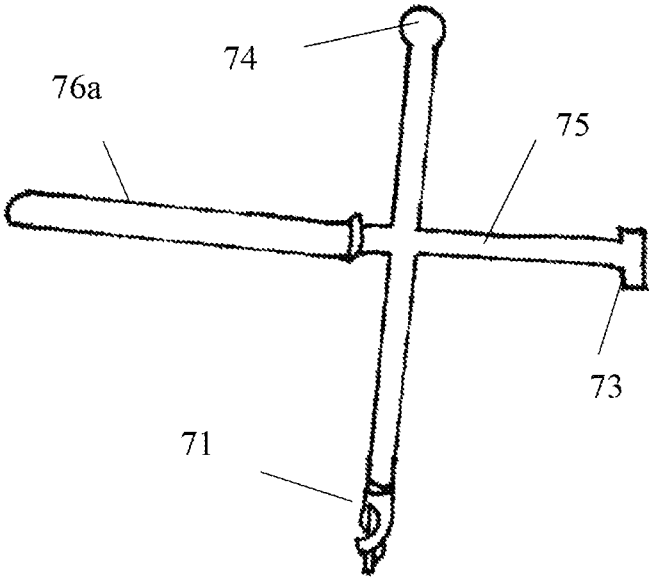
Figure 22:
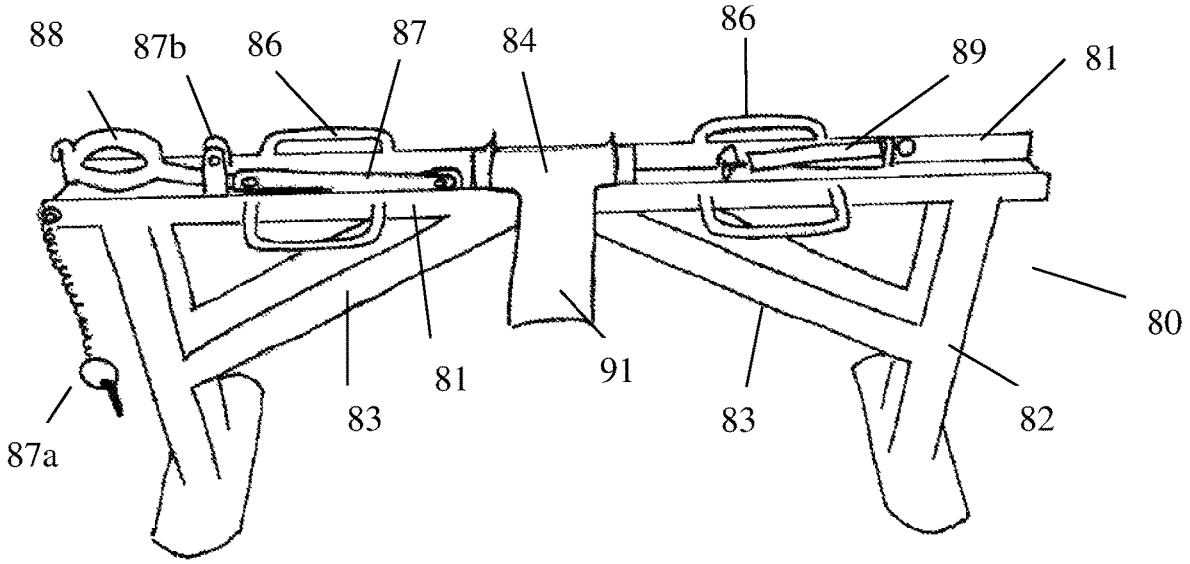
Figure 23:
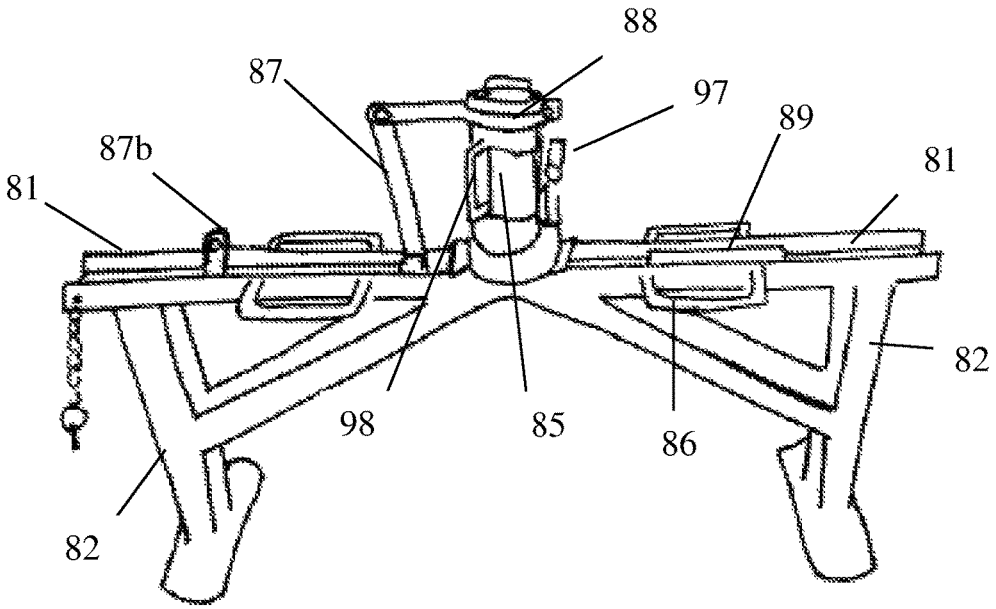
Figure 24:
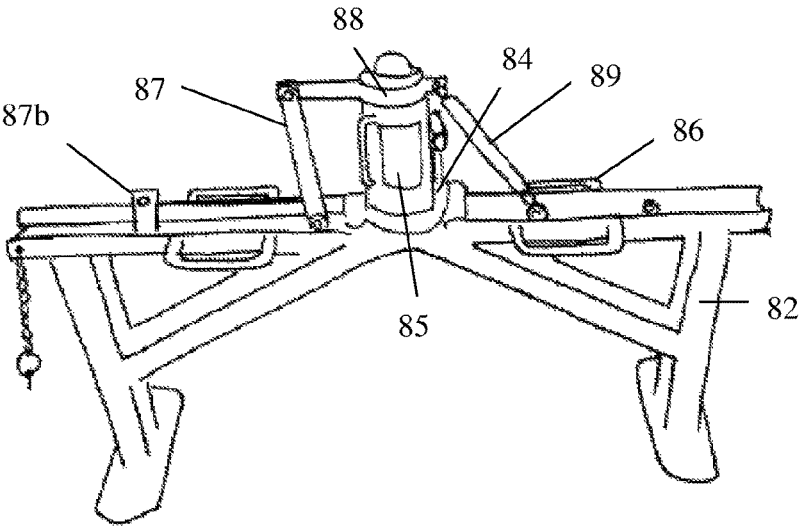
Figure 25:
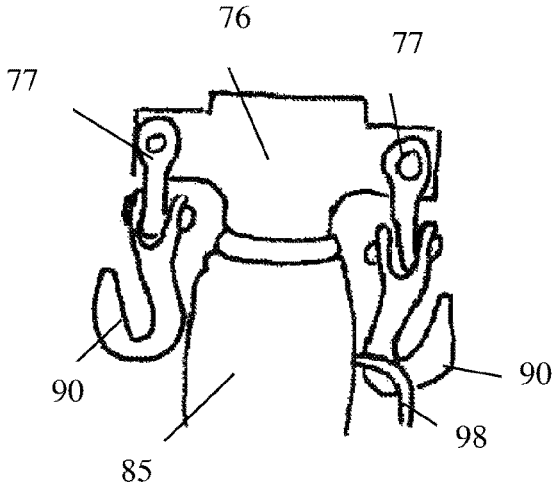
Figure 26:
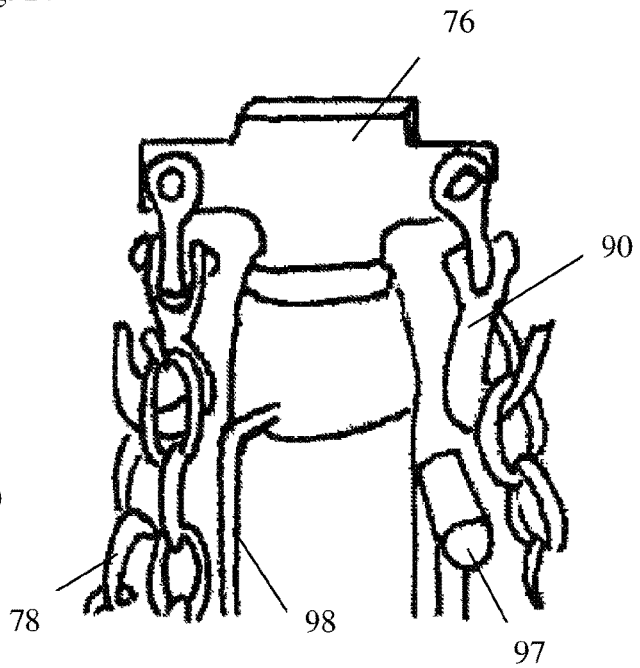
Figure 27:
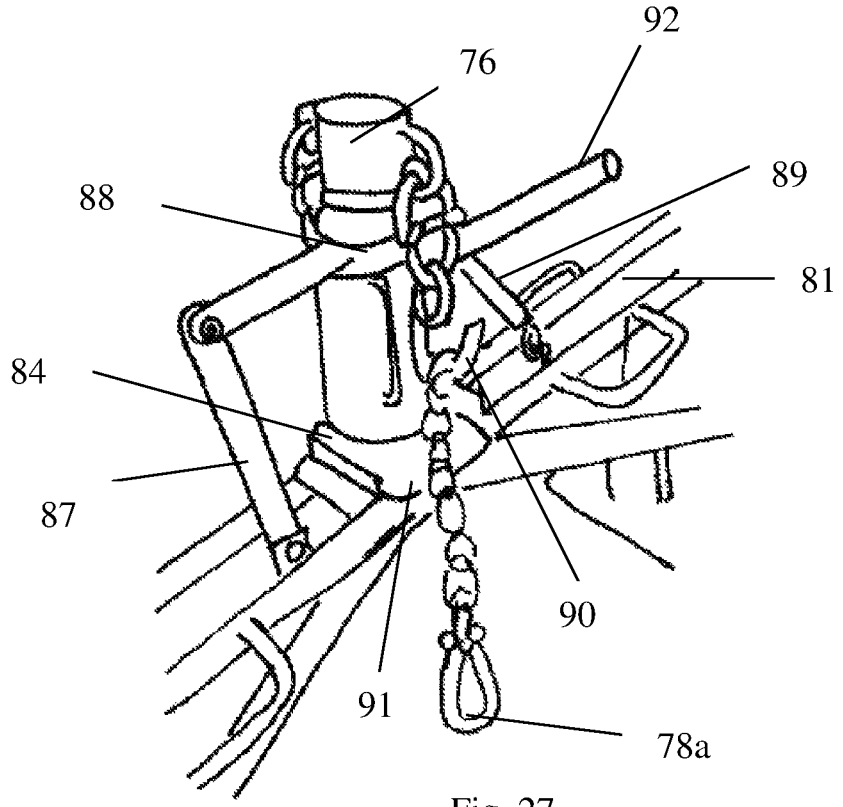
Figure 28:
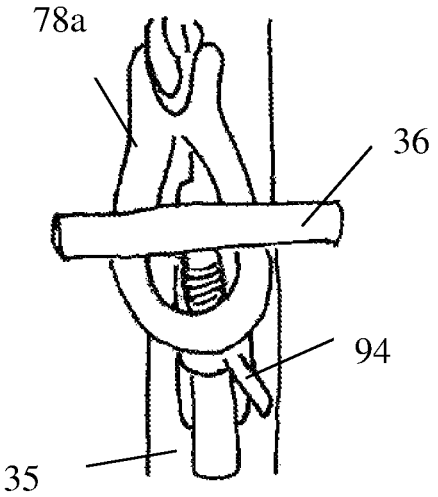
Figure 29:
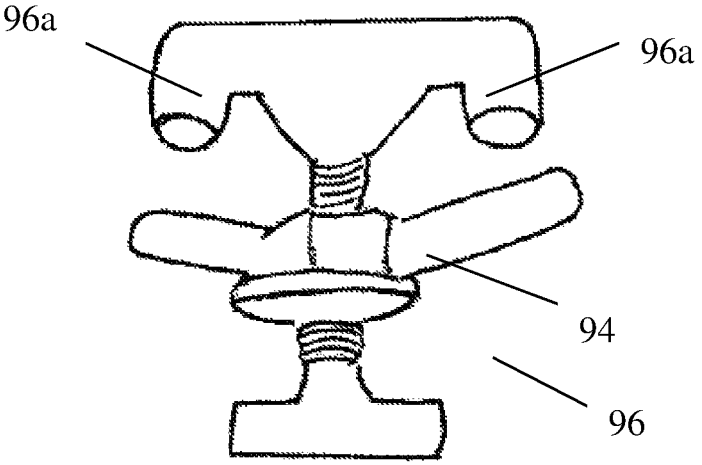
Figure 30:
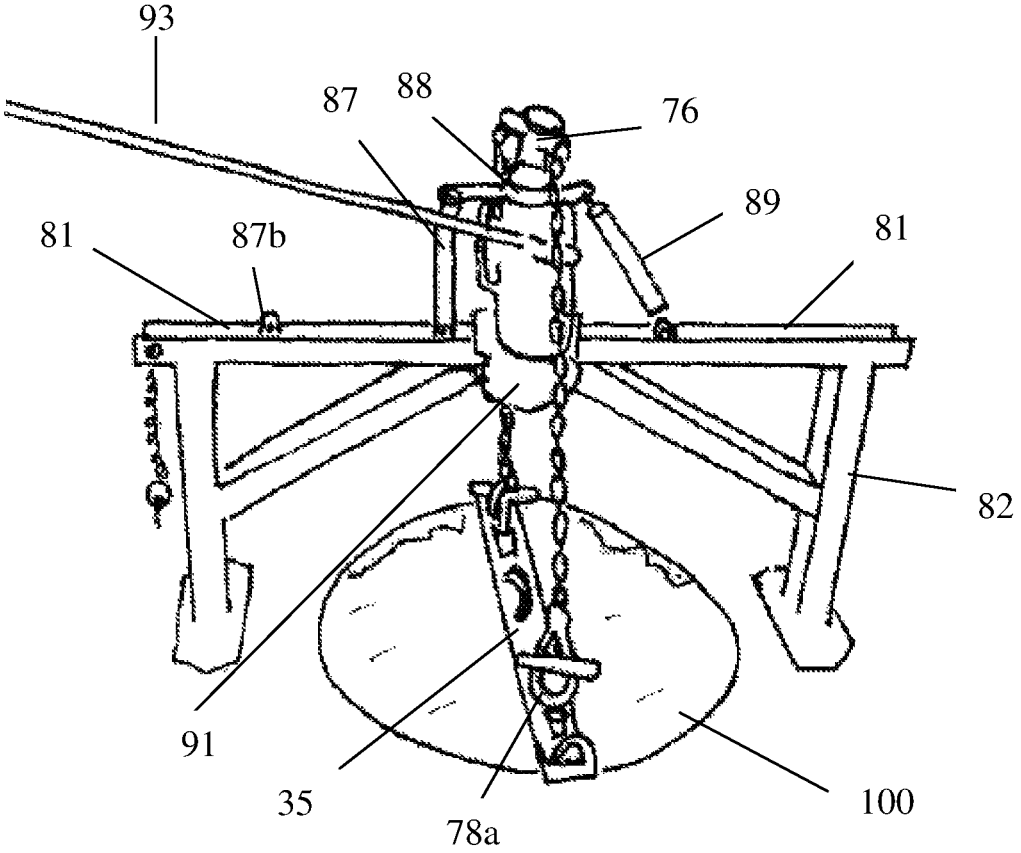

FIG. 19 is a schematic side cross sectional view a key insert recess opening;

FIG. 20 is a side perspective view of a multi-headed device according to the invention;

FIG. 21 is a further side perspective view of a multi-headed device according to the invention;

FIG. 22 is a side perspective view of a device for cracking the seal around a manhole cover according to the invention;

FIG. 23 is a side perspective view of the device of FIG. 22 with a bottle jack in position on the horizontal cross bar of the device;

FIG. 24 is a side perspective view of the device of FIG. 23 with the bottle jack fully secured in position on the horizontal cross bar of the device;

FIG. 25 is a side perspective view of a jack cap which fits over the bottle jack on the device according to FIG. 22;

FIG. 26 is a further side perspective view of the jack cap according to the invention;

FIG. 27 is a side perspective view of the jack cap fitted over the bottle jack on the device for cracking the seal around a manhole cover according to the invention;

FIG. 28 is an enlarged perspective view of a lifting eye around a manhole lifting key attached to a manhole lifting arm according to the invention;

FIG. 29 is a side perspective view of a manhole lifting key with angled arm according to the invention; and FIG. 30 is a perspective view of the device for cracking the seal around a manhole cover in working position over a manhole cover according to the invention;

DETAILED DESCRIPTION

Around a farm or in various occupations such as road maintenance where lifting and pulling is a common task people often get injured trying to tackle heavy tasks on their own.

Devices for lifting manhole covers are known. Devices for pulling and lifting fence posts are also well known. Some of these devices have pivoted arms or poles with working heads at one end, however in many instances the arms or poles are straight and do not allow for any leverage or take account of the different heights of users. A user has to bend to operate and manoeuvre the working head which can be very dangerous when lifting heavy weights and can result in serious injury. Other devices have telescopic arms which extend the lifting arm or pole, however extending in this way results in the strength of the lifting arm being significantly reduced. Other devices have pivot arms which are loosely fixed to a base section and rely on the weight being lifted to keep the pivot arm fixed to the base section. This is not very secure or safe in particular when a heavy weight is being lifted.

The present invention addresses the problems of known lifting devices and provides a sturdy multipurpose device combining several functions within a single tool. The multipurpose device of the invention may be used as a manhole cover lifter and replacer, a slab lifter, a concrete cattle slat lifter, a concrete plug lifter, a post or fence puller and/or as a lifting jack. The multipurpose device of the invention is a robust stand-alone device capable of operating on any type of surface such as rough ground or in soft, wet and/or muddy ground.

The multipurpose device has various working heads which may be attached to carry out the different tasks of lifting, pulling, grabbing, jacking etc. The multipurpose device is capable of lifting, pulling and/or moving a large weight. The stand-alone multipurpose device may be operated by an individual without any assistance. The multipurpose device is easily adjustable in height and length depending on the task involved and/or to suit the height of the user. The multipurpose device relieves any pressure on a users back or legs when lifting heavy weights. The user does not have to bend excessively when using the device of the present invention. Adjusting the height or length of the device does not reduce the strength of the device. The device is easily dissembled for carriage or transport.

Figure 1:
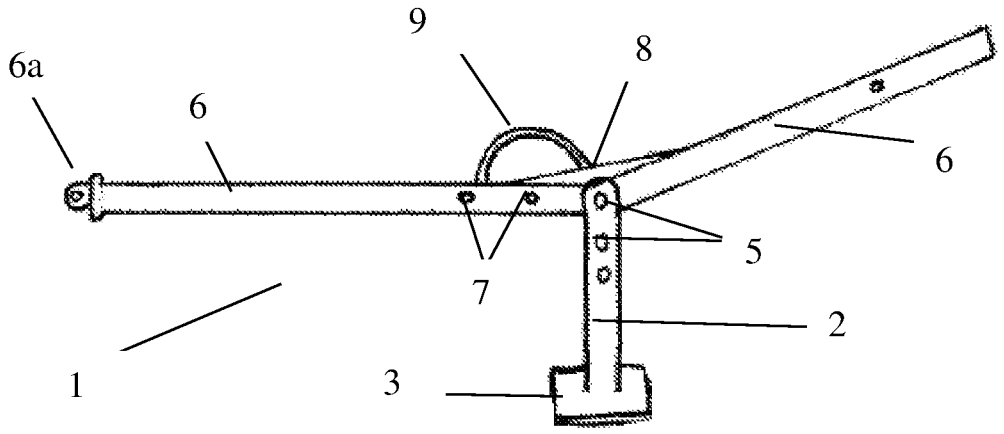
FIG. 1 is a side perspective view of a multipurpose lifting device of the invention.
Figure 2:
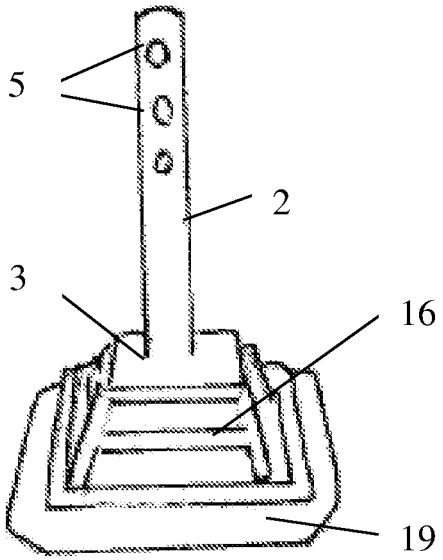
FIG. 2 is a side perspective view of the vertical support section of the multipurpose lifting device of the invention.

FIG. 1 shows a stand-alone multipurpose device 1 of the invention. The device 1 has an elongated vertical support section 2 with a planar base section 3. The upper end of the vertical section 2 has a substantially U-shaped receiving bearing 4 with a plurality of pivot slots 5 on either side of the U-shaped bearing 4. An elongated lever arm section 6 is pivotally attached within the U-shaped receiving bearing 4 to the elongated vertical section 2.

Figure 3:
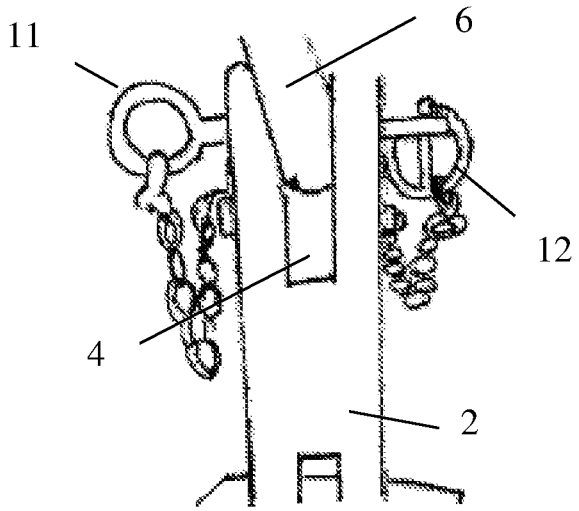
FIG. 3 is a perspective view of connection between the lever arm and the vertical support section of FIG. 1.

The lever arm section 6 has a number of apertures 7 which correspond with the pivot slots 5 on the U-shaped receiving bearing 4 on the vertical stand section 2. A pivot pin 11 is inserted through a pivot slot 5 on the vertical section 2 and a corresponding aperture 7 on the lever arm 6 to pivotally attach the lever arm 6 within the U-shaped receiving bearing 4. A spring clip 12 secures the end of the pivot pin 11 once in position. The pivot pin and spring clip are permanently connected on either side of the vertical stand section 2 by means of a chain link connection (FIG. 3) for ease of handling and to prevent loss of the pin or the clip.

The height of the lever arm where it is pivotally connected to the vertical support section 3 is adjustable. The lever arm 6 may be attached using a different height pivot slot 5 in the side of the U-shaped receiving bearing 4 on the vertical support section 2.

The lever arm section 6 is easily detached from the vertical support section 2 by releasing the pivot pin. The lever arm 6 has a handle 9 which allows the lever arm 6 and/or the lever arm 6 attached to the vertical support section 2 to the lifted and moved.

The elongated lever arm section 6 is angled for better leverage. A strengthening gusset 8 reinforces the angle and gives additional strength to the angled lever arm 6.

One end of the lever arm section 6 has attachment means 6*a* for quick release attachment of different working heads depending on the function the multipurpose device 1 is required to carry out. The attachment heads are attached by quick a release pivot and pin means. As described before the pivot pin and spring clip are permanently connected on either side of the lever arm section 6 by means of a chain link connection (FIG. 3) for ease of handling and to prevent loss of the pin or the clip.

The distance between the working head end 6*a* of the elongated lever arm 6 and the vertical support section 2 may be shortened or lengthened depending on the leverage required. The lever arm 6 has several apertures 7 which correspond to the pivot slots on the vertical section for receiving a pivot pin. Different apertures 7 on the lever arm 6 may be used depending on the distance required between the vertical support section 2 and the working head 6*a* of the lever arm 6.

Figure 4:
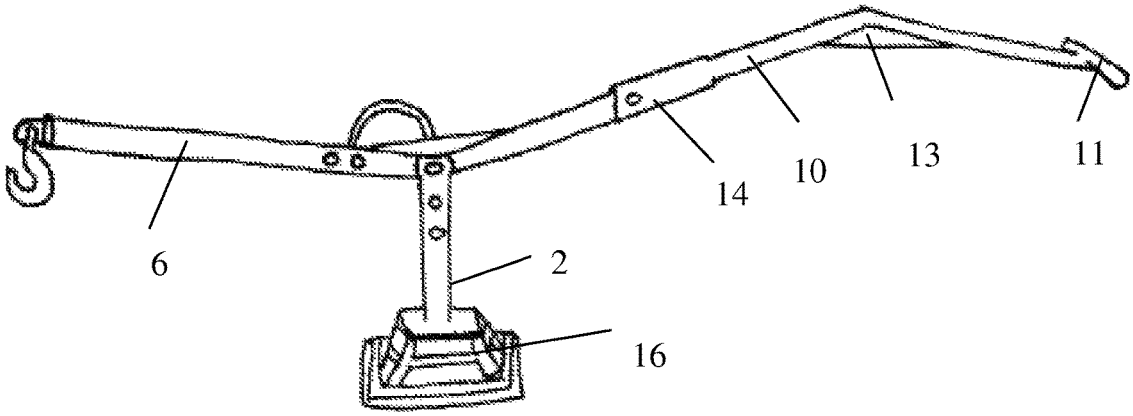
FIG. 4 is a side perspective view of the lifting device of FIG. 1 with an extension arm and handle attached.

The opposite end of the lever arm section 6 has means for attaching a detachable extension arm 10 with handle 11. The detachable extension arm 10 with handle 11 allows a user to hold the handle 11 and apply a downward force on the elongated lever arm section 6 of the device 1 (FIG. 4). The extension arm 10 and handle 11 come in various lengths so that the lever arm 6 may be extended as required. The extension arm 10 and handle 11 is angled for better leverage. The extension arm 10 has a strengthening gusset 13 which reinforces the angled arm 10. For heavy duty tasks when extra leverage is required a longer extension arm and handle may be attached to the lever arm section. For use in confined spaces a short extension arm and handle may be attached. For example when used to pull fence posts the device 1 of the invention may not require a long extendable arm and handle as the lever arm provides sufficient leverage. In this case a small extension arm with a handle may be fitted to the end of the lever arm section.

The extension arm and handle may be attached so that the handle is either angled downward as shown in FIG. 4 or angled upward. The different handle orientations allow the user greater leverage and also allows for different user's height.

Figure 5:
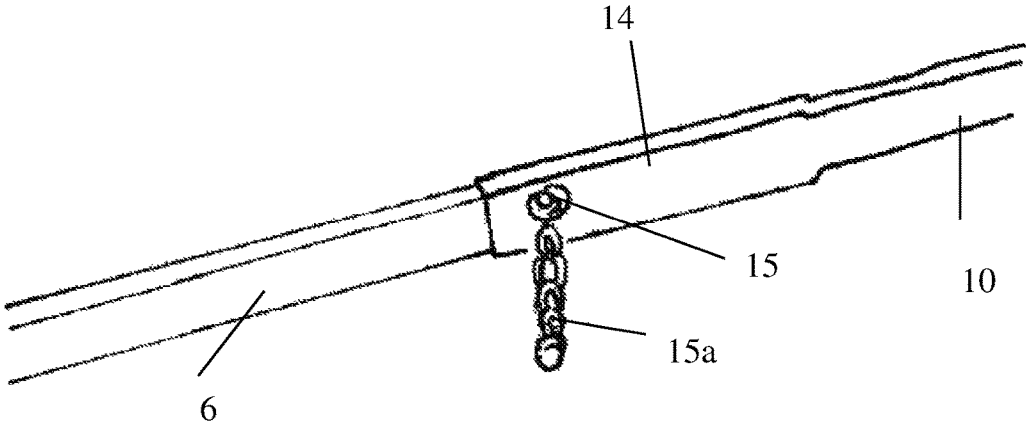
FIG. 5 is an exploded view of the receiving sleeve on the extension arm and handle according to the invention.

The extension arm 10 and handle 11 has an elongated receiving sleeve 14 at the end of the extension arm 10 distal to the handle 11. The receiving sleeve 14 is sized to fit snugly over the end of the lever arm section 6 (FIG. 5). The receiving sleeve 14 ensures that the width of the extension arm 10 is essentially the same width as the lever arm section 6 and ensures there is no reduction in size or strength of the arm by attaching the extension arm 10 and handle 11. The length of the receiving sleeve 14 is such that there is a sturdy and secure attachment between the extension arm 10 and the lever arm section 6 and the receiving sleeve 14 increases the overall strength of the lever arm section 6. The extension arm 10 and handle 11 are attached to the lever arm by a quick release means. The lever arm section 6 has apertures which correspond with pivot slots in the receiving sleeve 14 to receive a pivot pin 15. When the receiving sleeve 14 is fitted over the end of the lever arm section 6 a pivot pin 15 secures the extension arm 10 and handle 11 in position. A spring clip secures the end of the pivot pin once in position. The pivot pin and spring clip are permanently attached by a chain link connection 15*a* to the lever arm section for easy access.

Figure 6:
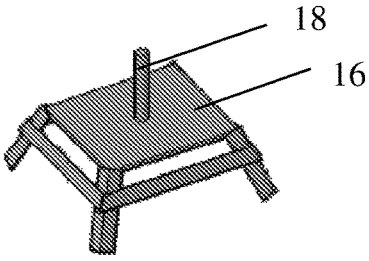
FIG. 6 is a side perspective view of a stool section according to the invention.
Figure 7:
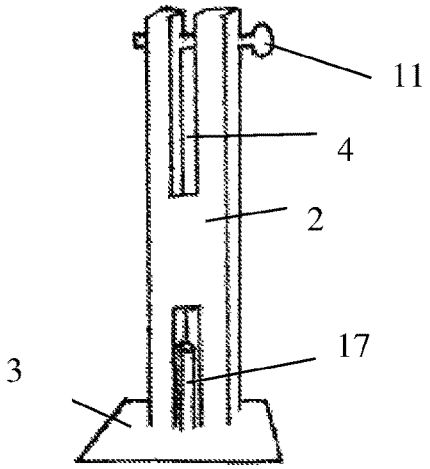
FIG. 7 is a side perspective view of the vertical support section of the multipurpose lifting device of the invention.
Figure 8:
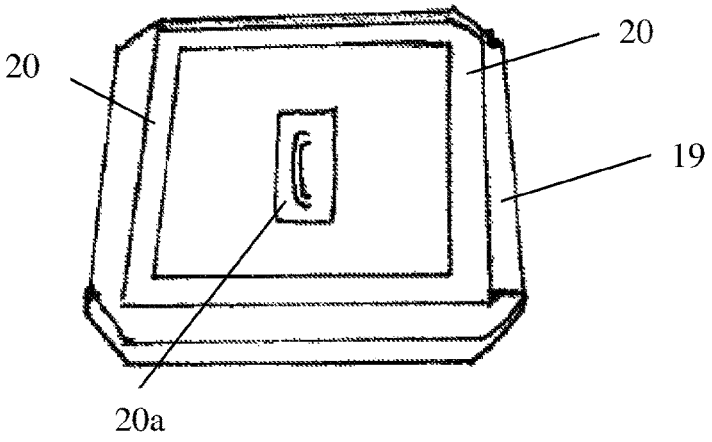
FIG. 8 is a side perspective view of a base plate section according to the invention.

The planar base section 3 of the vertical support section 2 may be pivotally mounted onto a stool section 16. Vertical support section 2 comprises a circular receiving opening or bushing 17 on the planar base section 3 for engaging with a corresponding circular bar 18 protruding from the stool section 16 (FIGS. 6,7). The circular bar 18 protruding from the centre of the stool section 16 fits snugly into the circular receiving bushing 17. The stool section 16 may be placed on a larger base plate section 19 (FIG. 8) for increased stability and purchase for certain types of surface such as wet ground to ensure the device does not sink. The larger base plate 19 is also useful on stony ground. The base plate section 19 has raised edging 20 stepped in from the outer edge of the base plate 19 to prevent the legs of the stool 16 from slipping off the base plate 19. The under surface of the base plate 19 may be fitted with a bubbled rubber surface to prevent the base plate from slipping. The base plate section 19 has a central handle 20*a* for ease of lifting and placement.

Mounted onto the stool section 16 the multipurpose device 1 is able to lift a heavy load and easily pivot the load up to 360°. The ability to pivot a heavy load is useful when the device of the invention is used to lift heavy items which need to be lifted and placed somewhere else for example grabbling large slabs and/or removing manhole covers. The multipurpose device 1 in position on the stool section is capable of lifting a weight of up to approximately 400 kg. The stool section 16 may be of different heights depending on the required use.

Figure 9:
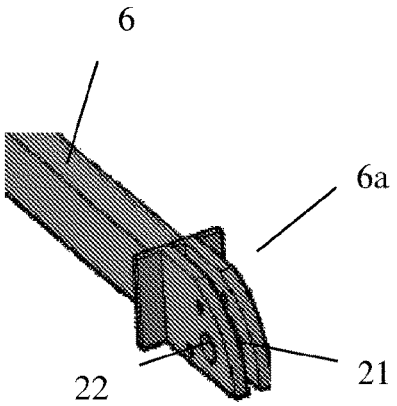
FIG. 9 is a side perspective view of the working end of the lever arm on the multipurpose lifting device according to the invention.
Figure 10:
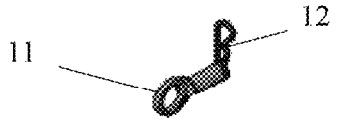
FIG. 10 is a side perspective view of a pivot pin and spring clip according to the invention.

The various working heads for attachment to the working end of the lever arm section 6 are attached by a quick release means such as by using a pivot and pin. The attachment means at the end of the lever arm 6 comprises a narrow receiving slot 21 into which the different working heads are inserted as shown in FIG. 9. A pivot pin is inserted through the receiving holes 22 in the receiving slot of the lever arm 6 and the corresponding receiving holes in the working heads. A pivot pin 11 is secured in position by means of a spring clip 12 (FIG. 10). The pivot pin and spring clip may be permanently attached to the lever arm 6 by a chain link connection to prevent it getting lost and for ease of use.

FIG. 11 (*a*-*d*) show the different working heads which may be used when using the device 1 of the invention to pull and remove fence posts. The T-bar head 25 (FIG. 11 (*a*)) is used to remove T-bar posts. The head 25 is placed over the post to be removed, placing it as close to the bottom of the post as possible. When pressure is applied by the user to the lever arm section 6, a tooth 26 on the inner side of the head 25 grips the steel post allowing the device 1 leverage to lift out the post. There is no need for multiple adjustments as the tooth 26 will allow the head to fall down naturally with a tap. One application of the lever arm 6 has been shown to lift a fence post up to 18 inches (approximately 46 cm).

A small fence post head 27 (FIG. 11 (*b*)) has an adjustable screw 28 which allows for a more secure fit on various sizes of posts. The head 27 is placed over the post to be removed and placed as close to the bottom of the post as possible. When pressure is applied the tooth 26 on the inside of the head 27 grips the post allowing the multi-purpose device 1 to lift up the post. One application of the lever arm 6 has been shown to lift a post up to 18 inches (approximately 46 cm). A large fence post head 29 (FIG. 11 (*c*)) is essentially the same and operates in the same manner as the small fence post head 27. It has a bigger circumference to fit around larger fence posts. An additional screw 30 provides additional stability/bite when lifting a post.

An open clasp head 31 as shown in FIG. 11(*d*) is suitable for posts where the top of the post does not allow a head to be attached. The open clasp head 31 is attached by opening the clasp 32, putting the head 31 around the base of the post, and closing the clasp 32. When pressure is applied the teeth 26 grip the post allowing the multipurpose device 1 to lift the post out without slippage.

The teeth on inner side of the heads only need to be repositioned when a post is sunk to an unusually large depth. If the post is sunk further than 18 inches. The head may be repositioned simply by tapping the lever arm section and the teeth drop down along the post. This is true for all the heads except the open clasp head 31. In this instance the user has extreme control over the fence post extraction process and the user does not want the head to fall down.

The multipurpose device 1 of the present invention is suitable for removing a variety of different types of posts, such as wood, metal and/or T-bar posts as the head on the device can easily be changed. The device can easily remove posts which are sunk to a depth of approximately 18 inches (46 cm). The fence posts heads are flexible around the pivot pin which allows for better placement when posts are sunken in unstable ground or at an angle.

Only one application of the lever arm is usually needed to remove posts in comparison to other devices where repositioning is required several times before a post is fully removed. The multipurpose device 1 of the invention has been found to be very effective even in ground which is wet and compacted and where suction is a major problem in removing fence posts. Use of the multipurpose device 1 of the invention also results in minimal damage to the posts during extraction.

The length of the lever arm section 6 in proportion to the pivot head where the lever arm 6 is connected to the vertical support section 2, coupled with the angle on the lever arm 6, allows an extracting head attached to the end of the lever arm section 6 to reach to ground level on a post. This allows a person to use their full body weight to apply pressure to the handle on the other end of the lever arm 6 and allows for maximum extraction. The angled extension arm 10 allows a person ease of use when applying pressure to the lever arm, while also giving additional leverage.

A jack attachment 33 as shown in FIG. 11 (*e*) may be attached to the lever arm section 6 when the device 1 is required to lift or jack up a heavy load. The jack attachment 33 is substantially L shaped. When using the lifting device 1 of the invention as a jack there is minimal risk of injury if for example the users hand slips during the operation. As the lever arm section 6 is long the user is at a safe distance from the working point. The angled lever arm 6 and extension arm 10 also means that less leverage is needed to lift an object. The use of the device of the present invention decreases the risk of whip lash or back lash. This is in comparison to many jack systems currently available where the user is very close to the working point and there is a high risk of injury.

Another attachment is a hook attachment 34 (FIG. 11 (*f*)). The hook attachment 34 is attached to the lever arm section by means of the pivot pin 11 and spring clip 12. The hook 34 may be used to lift manhole covers or cattle slats. It may also be used with a scissor grab 50 as shown in FIG. 14 to lift large slabs etc.

When used to lift a manhole cover, a manhole/cattle slat lifting bar attachment 35 is laid across the man hole or cattle slat. The lifting bar attachment 35 is attached to the manhole by means of keys 36 (FIG. 12(*a*)). There are different keys for different types of manholes.

The bar attachment 35 is placed across the manhole cover or slat. The keys 36 are inserted through the key receiving openings 37 on the manhole lifting attachment 35. Once the keys are through the bar 35 they are then slotted into the key inserts openings on the manhole cover. The keys are turned and secured in position.

The key 36*a* shown in FIG. 12 (*b*) is for lifting concrete cattle slats (normally covering slurry tanks). These keys need to be much longer than for manhole covers as the concrete slats are quite deep. When lifting cattle/concrete slats one end of the key 36*a* is inserted first through the key receiving slots 38 on the attachment bar 35 while the other end is passed through the gap in the cattle slats. The key is then turned to engage with the underneath of the cattle slat. The keys 36*a* are guided into place on the lifting bar attachment 35 by means of a safety angle stop 40 to ensure the keys remain safely in place once pressure is applied to the lever arm of the device 1. The safety angle stop 40 may be of different shape.

An electro magnet may also be attached to the hooking device 34 for manhole covers with no means of attaching keys.

The hook attachment 34 at the end of the lever arm 6 is hooked onto the lifting handle 39 of the manhole/cattle slat lifting bar attachment 35 as shown in FIGS. 15 and 16. Applying pressure to the opposite end of the lever arm section 6 the manhole cover or cattle slat may be lifted. The length of the lever arm ensures that there is no risk of the user being injured by the manhole cover or cattle slat as it is lifted and manoeuvred. Being able to adjust the length of the lever arm section 6 the user can very easily manipulate the manhole cover as required. The length of the arm 6 gives the user more leverage (hence they can lift a heavier load).

When used to remove a manhole cover or concrete slat the multipurpose device 1 may be mounted onto the stool section 16 to provide a pivoting lift. The vertical stand section 2 is able to pivot on the stool section 16 allowing flexibility and ease of use. There is no extreme bending of the users back required to apply leverage. In addition there is no heavy pressure on the users' legs. The arm extension 10 and the different manhole attachments attached to the end of the lever arm 6 ensure that the device 1 of the invention is suitable for use with a large variety of different types of manhole covers. For manhole covers which may not have keys an electro magnet may easily be attached by means of the attachment hook 34. The manhole lifting attachment is not fixed, which allows greater flexibility. The user selects the leverage settings before starting the lift which means less time is wasted adjusting the settings. There is no changing of settings mid operation. In addition the length of the lever arm section 6 with or without the extension arm 10 ensures that the user is a safe distance from sewer fumes and open man holes.

A scissor slab lifter grab attachment 50 shown in FIG. 14 is used to lift and manoeuvre large slabs etc. The hook head attachment 34 is secured to the centre of the chain 51 at the top of the grab attachment 50. When pressure is applied to the lever arm section 6 of the device 1 the grab attachment 50 closes around the object being lifted. A lip 52 on the lifter grab attachment 50 along with the weight of the object being lifted provides the necessary grip to safely secure object and lift it.

The multipurpose device 1 of the invention may be used to carry out many tasks in various working conditions. The larger base plate section 19 may be used to provide a bigger footprint in soft ground, thus preventing the tool from sinking. Different height stool sections 16 may be used to provide the best leverage—and height clearance. The lever arm section 6 may be adjusted and/or extended and the various working head attachments may be interchanged to suit the task. The user can adjust the settings on the stand-alone multipurpose device before beginning a specific task, no further adjustments are needed.

The stand-alone multipurpose device 1 of the present invention is very time efficient to use. The device 1 of the present invention requires fewer movements of the lever arm to remove a fence post. One person can easily remove a relatively heavy object reducing the need for a second person. There is no extreme back bending required to apply leverage, and no substantial use required by the legs. Overall less effort is required by an individual to carry out heavy tasks that are known conventionally as back breaking tasks.

The multipurpose device 1 of the invention is of simple construction having few component parts. It is capable of withstanding heavy repeated use. It is a stand-alone unit. The shape and length of the lever arm section 6 means that fewer movements are required to remove for example a sunken fence post. The lever arm section provides a means of easily removing even well sunken posts or moving heavy items without the risk of injury. In addition the user is at a safe distance from the working point of the device thereby minimising the risk of injury.

The grabbing/gripping teeth of the working fence post heads are enclosed and therefore will only apply leverage to what is within the enclosed area. This ensures safe usage. At the moment of extraction the user has more control over the process. The user is able to select the leverage settings before starting a project. The device 1 provides ample leverage without having to readjust settings which mean less time is wasted during the job and it is safer. The user is at a safe distance from the working head while carrying out the job. The device is also designed so that a single user may complete a job, the settings are adjusted at the start and do not need to be re-adjusted during the job. This is both time saving and safer.

In another embodiment of the invention the stand-alone multipurpose lifting device has a wheeled base section 60 (FIG. 16). The wheeled base section 60 comprises a substantially rectangular shaped platform 61 to which the vertical support section 2 is permanently attached towards the front of the platform 61. A spring buffer 62 means comprising a small box stand with a spring on top is attached towards the rear of the platform 61. The spring buffer 62 prevents the multipurpose device 1 from overbalancing or tipping when under pressure when lifting a heavy load. When the multipurpose device tip's forward, the lever arm section 6 will hit the spring buffer 62 and the device will right itself allowing the user to continue forward unhindered.

The wheels 63 on the wheeled base section 60 are flat free wheels that do not puncture. Flat free wheels are essential when the device is being used on rough ground to prevent punctures. They also provide suspension when the device is being moved over rough ground or gravel surface. The two front wheels are fixed while the two back wheels are fully rotating to facilitate free movement.

In use, the wheels act as a fulcrum and, when a lifting attachment has been attached to the object to be lifted, downward pressure on the handle of the device will exert a lifting force on the object. By providing a sufficiently long and rigid handle a sufficiently high mechanical advantage can be achieved to enable heavy objects such as manhole covers to be lifted by one man. Once the cover has been lifted it can be easily moved on the wheeled base section 60 away from the manhole by application of continuous downward pressure to the handle 11 on the lever arm 6. The lever arm is also used to guide the movement of the wheeled base 60. The manhole cover may be lowered to the ground at a convenient point to await replacement on the manhole opening by the multipurpose lifting device of the invention.

The stand-alone multipurpose device 1 of the invention may be manufactured from any suitable material which provides a sturdy and lasting device. The large base plate section 19 may be made of durable plywood. This provides a much lighter unit but it is also still durable and fit for purpose. The large base plate section 19 may have a rubber base to prevent slippage. The rubber base may also have rubber studs to increase the grip. The surface of the area inside the raised edges 20 where the stool 16 rests is reinforced to prevent the legs of the stool digging into the wood over time. The surface may be covered for example with a sheet of tin.

The stand-alone multipurpose device 1 of the invention is capable of lifting a load of up to approximately 400 kg depending on the strength of the operator.

The stand-alone multipurpose device 1 of the invention is very advantageous when used in lifting manhole covers which can be very awkward and heavy to manoeuvre. Manhole covers are everywhere concealing essential access means to various services. Manhole covers are regularly lifted to check and maintain services. Other manhole covers may be left in place for many years before they need to be lifted.

Manhole cover key recess openings are conventionally plugged with a rubber or another type of removable plug, bung or cover to prevent the key recess or insert opening being filled with dirt and debris. Invariably however the plug or cover is lost or removed and very quickly the key recesses are filled with dirt and debris. The dirt and debris soon becomes compacted. As a result it is difficult if not impossible to insert a manhole lifting key into the key recess opening when the manhole cover needs to be lifted.

Typically manhole covers are in positions where quick access is required and having to clean out the key recesses can be a time consuming and tedious job. The shape of the key recess opening, long and narrow, means it is difficult to access and remove any dirt and debris gathered and/or compacted within the opening. It is especially difficult to clean the deepest point of the key insert opening where the manhole lifting key needs to turn and lock. Currently the system for cleaning key recesses is to use a screwdriver or where the debris is severely compacted a hammer and chisel is used to try and dislodge the debris before a manhole key can be inserted to lift the manhole cover. In icy/frozen conditions a blow torch may have to be used to thaw the key recess before it can be cleaned. None of these methods provides an easy method for cleaning the recess. They may clean the main cavity of the key recess but they do not clean the inside/underside of the key recess.

FIG. 17 shows a typical manhole cover 67 with two key insert recess openings 68. A typical manhole lifting key 36 used for lifting a manhole cover is shown in FIG. 14. The key recess insert opening 68 has two narrow side openings A, C with a larger central opening B as shown in FIG. 18. It is especially difficult to clean the deepest point of the key insert opening 68 where the manhole lifting key needs to turn and lock as shown in FIG. 19. The compacted debris D makes it impossible to fit a lifting key securely into the recess.

Another embodiment of the present invention provides a multi-headed device 70 (FIGS. 20, 21) which can be used to systematically clean any type of key insert recess 68 in a manhole cover 67. The multi-headed device 70 ensures a fast and simple method of clearing and removing compacted dirt and debris from a key insert opening 68. The device 70 comprises four different working heads combined within a single multi-headed device.

The multi-headed device 70 of the present invention comprises four working heads, an auger head 71, a screwdriver head 72, a splayed key head 73 and a ball head 74. The multi-headed device 70 is essentially in the form of an X-shape. The combination of these working heads in a single device provides a fast and easy method to clear out a key opening in a manhole cover.

The different working heads are located at the end of elongated arms 75 which form an X shaped device. Each arm 75 is substantially perpendicular to one another. The multi-headed device 70 combines different working heads in a single tool which allows for easy selection of a working head as required for each task. The elongated arms allow easy operation of the heads.

To clean a manhole key recess opening 68 the auger head 71 is first positioned in the key recess. The arms 75 of the tool are rotated, causing the auger head 71 to rotate within the recess, which in turn, causes the debris in the key insert recess to be pushed up through the auger head and deposited outside of the key recess with minimal effort. The auger head 71 is also very useful when the recess is filled with frozen water in the winter months. The auger head 71 is held in place by a grub screw and can be detached and replaced or exchanged for a different size auger where required.

At the opposite end of the auger head is a ball head 74. The ball head 74 allows the user to apply body weight to the auger head 71 when clearing heavily compacted debris. This also speeds up the time it takes to clean a key insert recess. The more weight applied, the quicker the auger head 71 will cut through the debris.

It is important to keep the auger head 71 as vertical as possible as it works much less efficiently at an angle. The ball head 74 allows for easy manipulation of the auger head 71. The user can twist the auger head 71 and keep the auger head 71 at a vertical angle to the key opening 68 without any discomfort.

Where the key recess 68 is filled with cement, tar, ice or such like, the task of cleaning it becomes much more difficult. If the recess is filled with tar, ice or cement it makes the job of cleaning much more difficult. In normal circumstances if the debris is loose it will fall naturally into the cavity left by the auger head. This is not true for cement, ice or tar. Using the screwdriver head 72 on the multi-headed device 70 of the present invention the cement, ice or tar can to be pushed into the centre cavity of the recess. The screwdriver head 72 is positioned at the edge of the key recess and tapped lightly with a hammer. This will push the solid debris in the centre recess cavity, where it can be removed by the key head 73 or auger head 71.

The screwdriver head 72 is curved to allow the user easier access to the inner underside of the key recess. The screwdriver head 72 can scrape the debris out from the underside cavity. This cleans the inside of the key recess and creates space for the splayed key head 73 to be inserted and rotated in order to clean out the inside. The screwdriver head 72 is held in place with a grub screw and can be detached and exchanged or replaced where required.

The fourth working head of the multi-headed device 70 is a splayed key head 73. Before using the splayed key head 73 the screwdriver head 72 is covered by a spring loaded cover **76*a*. The cover 76*a* is placed over the screwdriver head 72 and pushed against the spring 77*a* and twisted to engage a catch and lock the cover in place. The cover 76*a*** may be made from a heavy plastic material or any other suitable material.

Once the screwdriver head 72 is covered the splayed key head 73 may be inserted into the space cleared by the auger head 71. The splayed key head 73 is turned 180 clockwise then 180 anticlockwise to clear out side section. This process is repeated until one can fully turn the key 360. The key recess is now cleared. The key head 3 is at a slight angle, splayed, which results in debris being pushed out from underneath the recess, up and out of the key recess during rotation. This not only clears the debris away but also pushes it up out of the cavity. Manhole lifting keys may now be inserted to lift the manhole cover.

Different manhole covers have different sized key inserts. Having a detachable auger head and screwdriver head means that the different sized heads may be easily interchanged depending on the size required for the size of the key recess.

Manhole covers over services which have been left in position for a considerable length of time invariably can become very difficult to open. The road may have been resurfaced and the edges of the manhole cover covered up. Manhole covers themselves can be extremely heavy and cumbersome and when they are not regularly lifted, debris and other material in addition to general wear and tear result in the covers being firmly stuck into place. It is very difficult if not impossible for an individual to move and lift such manhole covers. This makes the job of accessing services through manholes more time consuming. Even after their keyhole recess openings have been cleaned some manhole covers can be impossible to crack open.

Another embodiment of the invention provides a device 80 for cracking any seal which has formed around the outer edges of a manhole cover. The portable device 80 may easily be used by an individual. The cracker device 80 operates and engages with a manhole lifting attachment bar 35 which has been attached to the manhole cover 100 using manhole lifting keys **36*a* to release and loosen the sealed manhole cover. Once the manhole cover 100 has been opened the cracker device 80 may be removed and the multipurpose lifting device 1 of the present invention may be wheeled into position, the manhole lifting attachment bar 35 attached to the lever arm 6 on the multipurpose device 1** and the manhole cover lifted off and removed.

FIG. 22 shows the cracking device 80 of the invention. The device 80 has an elongated horizontal cross bar section 81 and two opposed leg sections 82. Support struts 83 reach between the cross bar 81 and the leg sections 82. The elongated horizontal cross bar section 81 has raised sides with a channel recess along its length. In the centre of the horizontal cross bar 81 there is a recess 84 for receiving a conventional bottle jack device 85. On either side of the recess 84 and extending perpendicular to the horizontal cross bar 81 there is a guide channel or spreader 91 for guiding the lifting chains 78. The device 80 has a handles 86 for easy lifting and manipulation of the device.

On one side of the recess 84 a folding elongated arm 87 is attached to the horizontal cross bar 81. The elongated arm

87 has a circular head 88 at one end which fits over the bottle jack mechanism 85. When not in use, the arm 87 folds back into the channel recess of the horizontal cross bar 81 and is pinned in place with a spring clip 87*a* which is permanently attached to the inside of the channel recess. The spring clip engages with a spring clip receiving means 87*b* on the horizontal cross bar to pin the elongated arm 87 down. On the other side of the recess 84 is a folding spring mechanism 89. When not in use the spring mechanism 89 lies flat within the channel iron recess of the horizontal cross bar 81.

A jack cap 76 with a lifting eye 77 on either side of the cap is attached to the top of the bottle jack mechanism 85 as shown in FIGS. 25, 26. Lifting chains 78 are permanently attached to the lifting eyes 77. The lifting chains 78 have lifting eyes 78*a* at one end. The jack cap 76 has two hooks 90 on either side for shortening the lifting chains 78 when required. The guide channel or spreader 91 guides the lifting chains and ensure they do not interfere with the operation of the cracker device 80.

In use a manhole lifting attachment bar 35 is placed over the manhole cover 100 to be lifted (FIG. 30). Two lifting keys 36*a* are inserted through the bar 35, into the key recess in the manhole cover, turned and tightened securely. The cracker device 80 of the invention is positioned over the manhole cover 100. A bottle jack 85 is placed into the recess 84 provided on the horizontal bar 81. The bottle jack may vary in size depending on the weight the cracker device 80 is required to lift. The bottle jack has a handle 98 for ease of lifting and positioning. Bottle jacks come in standard sizes, for example, 1 ton, 2 ton etc depending on the lifting capability required. The bottle jack 85 has a jack pump 97 on one side into which a handle 92, 93 is attached for pumping the bottle jack 85.

The elongated lever arm 87 on the cracker device 80 is brought up until the circular head 88 reaches over the bottle jack 85. The folding spring mechanism 89 on the other side of the bottle jack recess is brought up to attach to the circular head 88 securing the circular head 88 around the bottle jack 85 to hold the bottle jack 85 securely in place on the horizontal cross bar 81. The jack cap 76 with the lifting chains 78 hanging down on either side is placed over the head of the bottle jack 85. The lifting eyes 78*a* of the chains 78 are placed around the lifting keys 36*a* secured to the manhole lifting attachment bar/bar 35 placed across the manhole cover 100. The lifting chains 78 are tightened by lifting any loose section of chain into the hooks 90. This shortens the time needed to apply tension to the chain 78. A small handle 92 is placed onto the jack pump 97 and the bottle jack 85 pumped a little to complete tightening of the lifting chains 78. A larger pumping lever 93 is then attached onto the jack pump 97 and the bottle jack 85 pumped until the seal around the manhole cover 100 is cracked and the manhole cover is lifted.

Once the seal around the manhole cover has been cracked the jack is released/let down. The lifting eyes 78*a* of the lifting chains 78 may then be unhooked from the lifting keys 36*a* and the device 80 of the invention moved away from the manhole. The multipurpose lifting device of the invention may then be used to lift and remove the manhole cover.

For situations where there is only a single key recess in the manhole or service access cover a single manhole lifting key needs to be used. The lifting eye 78*a* of the lifting chain 78 connected to the jack cap 76 is attached over the head of the lifting key. In order to ensure that the lifting chain 78 remains securely attached to the lifting key a lifting key 96 with bent arms as shown in FIG. 29 is used. The curved or bent arms 96*a* of the lifting key 96 prevent the lifting chains 78 from slipping off mid lift. The lifting key 96 also has a tightening screw 94 for safety which is turned to secure the key to the cover being lifted. In this case especially where the lifting chains on either side of the jack cap are attached to a single lifting key it is particularly important that the lifting chains are kept away from the operation of the jacking mechanism. Therefore the lifting chains are guided over the guide channel or spreader 91 on the cracker device 80.

The cracker device 80 may be easily and quickly dismantled for carriage and storage. The cracker device 80 of the invention is capable of lifting several ton. The cracker device 80 of the invention is capable of lifting up to approximately 3,000 Kg.

A major issue when lifting manhole covers is to assess the levels of fumes/toxic gas underneath. Using the cracker device 80 of the present invention when the manhole cover has been raised a little, gas testing equipment may be inserted into the opened recess and the user can step back a safe distance until the test is completed.

The devices 1, 70 and 80 of the invention may be manufactured from any suitable material which provides a sturdy and lasting device. The devices 1, 70 and 80 may be galvanised or weatherproofed by any suitable means to protect them. This would be particularly beneficial in areas close to the sea where salt water is a major cause of rust or in large cities where roads are continually being salted causing an increased risk of rusting.

The invention is not limited to the embodiment hereinbefore described, with reference to the accompanying drawings, which may be varied in construction and detail.

What is claimed is:

1. A device for cracking a seal formed around a manhole cover comprising: a horizontal cross bar section comprising a bottle jack holder recess for receiving a bottle jack; a guide channel, said guide channel extending on a longitudinal side of the horizontal cross bar section and oriented perpendicular to the horizontal cross bar section;

two opposed leg sections extending from opposite ends of the horizontal cross bar section;

two support struts each extending between the horizontal cross bar section and one of the two leg sections;

and a jack cap section comprising two lifting eyes, each lifting eye comprising a hook and a lifting chain for attaching to a manhole lifting key detachably connected to a manhole cover, wherein the jack cap section is configured to be disposed directly on a head of the bottle jack such that at least one of said lifting chains extends downward on one side of the bottle jack and along said guide channel to the manhole lifting key and wherein said at least one of said lifting chains is biased away from said longitudinal side of the horizontal cross bar section by said guide channel.

2. The device as claimed in claim 1, further comprising a bottle jack retaining means for retaining the bottle jack to the device.

3. The device as claimed in claim 1, wherein the device is configured to exert a pressure up to 3000 kg in weight.

4. The device as claimed in claim 1, wherein a foot is disposed at an end of each of the two opposed leg sections.

5. The device as claimed in claim 2 wherein the bottle jack retaining means comprises a retractable lever arm on one side of the bottle jack holder recess comprising a circular head section and a retractable spring on an opposite side of the bottle jack holder recess wherein the circular head section of the retractable lever arm in a working position fits around the bottle jack and is secured in place by the retractable spring.

6. The device as claimed in claim 1, wherein each respective said lifting chain is separately coupled to the jack cap section at a top of the bottle jack.

7. A device for cracking a seal formed around a manhole cover comprising:

a horizontal cross bar section comprising a bottle jack holder recess for receiving a bottle jack;

a guide channels, said guide channel extending on a longitudinal side of the horizontal cross bar section;

two opposed leg sections extending directly from opposite ends of the horizontal cross bar section;

two support struts each extending between the horizontal cross bar section and one of the two leg sections;

and a jack cap section comprising two lifting eyes, each lifting eye comprising a hook and a lifting chain for attaching to a manhole lifting key detachably connected to a manhole cover, wherein the jack cap section is configured to be disposed directly on a head of the bottle jack such that at least one of said lifting chains extends downward on one side of the bottle jack and along said guide channels to the manhole lifting key and wherein said at least one of said lifting chains is biased away from said side of the bottle jack by said guide channel.

* * * * *